US005685765A

United States Patent [19]

Azpeitia De Diego

[11] Patent Number: 5,685,765

[45] Date of Patent: Nov. 11, 1997

[54] MACHINE FOR GRINDING ROTOR BLADES PROVIDED WITH A ROTOR SUPPORTING DEVICE

[75] Inventor: Angel Ramon Azpeitia De Diego, Deba, Spain

[73] Assignee: Polígono Industrial Arriaga, Elgoibar, Spain

[21] Appl. No.: 544,958

[22] Filed: Oct. 18, 1995

[30] Foreign Application Priority Data

Oct. 18, 1994 [ES] Spain ..... P9402175

[51] Int. Cl.[6] ..... B24B 49/00

[52] U.S. Cl. ..... 451/9; 451/10; 451/11; 451/218; 451/242

[58] Field of Search ..... 451/242, 246, 451/9, 10, 11, 212, 213, 218

[56] References Cited

U.S. PATENT DOCUMENTS

| | | | |
|---|---|---|---|
| 3,769,756 | 11/1973 | Kipple et al. | 451/9 |
| 3,855,736 | 12/1974 | Porter, Jr. | 451/9 |
| 4,811,524 | 3/1989 | Corallo | 451/9 |
| 5,303,511 | 4/1994 | Tsuchiya et al. | 451/11 |
| 5,441,437 | 8/1995 | Hulstedt | 451/9 |
| 5,486,130 | 1/1996 | Kilmer, Jr. | 451/11 |
| 5,562,526 | 10/1996 | Yoneda et al. | 451/9 |

*Primary Examiner*—James G. Smith
*Assistant Examiner*—Dona C. Edwards
*Attorney, Agent, or Firm*—The Kline Law Firm

[57] ABSTRACT

A machine designed to grind the rotor blades of aeronautical engines includes a bench with a sliding table which holds the rotor supports. The rotor supports include a side stand point and a side stand counterpoint, both of which are combined with a bridge frame over which the rotor is suspended. The stands have elastic joints which have associated optional blocking mechanisms that are controlled by the machine's CNC control. The table has sliding supports which also include mechanisms for optional blocking. When the blocking mechanisms of both the elastic joints and the table supports are utilized, a high precision balancing and rectifying operation is achieved.

1 Claim, 2 Drawing Sheets

9a
9
9a 10
12
11
9
5
7
4
4a
4a
4a
8
6
13
8a
8
8a 12
10
12a
12a
12
11

MACHINE FOR GRINDING ROTOR BLADES PROVIDED WITH A ROTOR SUPPORTING DEVICE

FIELD OF INVENTION

The present invention relates to a machine for grinding the blades of an aeronautical or similar engine rotor, and particularly to the means for supporting the rotor on the machine, and the means for driving and moving the rotor.

BACKGROUND OF THE INVENTION

The modern and expensive rotors of compressors and turboreactor turbines of the aeronautical and similar industries are provided with blades loosely joined together, perfectly distributed in segments or stages of graded diameters. With the rotor stopped, these blades stay lowered on the central shaft and only when the rotor reaches speeds of 2500 or 3000 R.P.M., do these blades take on their normal working position standing up or erected.

The dimension and form of the active profile of the blades must have maximum precision to achieve the best possible engine performance and least possible noise. To achieve the precise active profile, the blades are processed by means of balancing and rectification operations, while the rotor is in its normal condition, that is to say turning at the previously mentioned high speeds in which all blades are raised by the centrifugal force. Machines for grinding the blades or a rotor or an aeronautical engine are equipped for carrying out both processes, the dynamic balancing of the rotor and the grinding of the rotor blades. The rotor is supported by stands over a table which is displaced in the axial direction by sliding on the machine bed which is fixed to the floor. In the present application the grinding machine is also referred to as a rectifying machine or grinder, and the rectification operations are also referred to as grinding or mechanizing the blades profile. The rotor must be balanced prior to the rectification process, because the rotor must rotate with no vibration during the grinding of the blades at the highest speed value. The balancing process comprises measuring the rotor vibration and adding peripheral masses in order to decrease the rotor vibration below a limit permissible value for a given rotational speed. The measured magnitude of vibration depends on the oscillation of the whole machine structure, that means its natural resonant frequency. This is the reason to separate the stands supporting the rotor from the machine structure by providing the rotor stands with freedom from oscillating, so that the measured vibration is not affected by the mass of the sliding table and the bed of the machine. The rotor is also balanced after the rectification is finished, because the rotor must be delivered with no imbalance. Rectifiers exist which are able to perform this mechanizing operation with a precision of 5 microns, referring to a single rectifying operation.

So that the rectifier does not look changed due to the rotor spinning at high speed, it is essential that before and after the rectification, a dynamic balancing of the rotor rotating at around 900 R.P.M. should take place on the rectifying machine itself.

In known rectifying machines, the rotor is installed to rotate on a stand which is not in a single piece, and which is elastically joined between the rotor support parts and the table which holds the stand. In this manner, the joints provide an elastic mobility of 25 microns to absorb vibrations generated in the rectifier until the rotor is balanced.

However, the stand's elastic mobility, so convenient and necessary for the preliminary balancing of the rotor, results later in being self-defeating to rectifying precision. Lateral thrust generated when the grinder wheel is placed on the rotor may cause the rotor to experience a lateral displacement five times greater than the precision required during a single rectifying operation. Further, due to the lateral displacement of the rotor, the grinding operation takes longer.

Another inconvenience found in the known rectifying machines is that the table on which the stands of the rotor and also the rotary drive unit are installed is in turn supported on the bed by simple gravity with the possibility of sliding freely over the bench. This free movement of the table in relation to the bed is an inconvenience during balancing. This can and does happen, distorting the magnitude and inclusively the sense of the actual imbalance, so its measurement would be out-of-line and would seriously affect the result of later rectification processes.

SUMMARY OF THE INVENTION

The object of the present invention is to provide a grinding machine equipped with a CNC control for rectifying the blades of engine rotors. The machine comprises a machine bed on which is mounted a sliding table that bears the rotor supporting means between separated stands. The machine also includes a rotary drive to rotate the rotor at high speed. The rotor supports are a bridge type frame formed by a cradle over which the rotor to be rectified is operatively suspended, and includes two stands each having one pair of elastic joints. The elastic joints have associates means for optionally blocking the elastic flexure of the stands supporting the rotor which are activated or deactivated in combination with the CNC control depending on the process carried out. The CNC determines a no-blocking condition when rotor vibrations for balancing are being verified or a blocking condition to obtain rigidness of the stands when the rectification is done.

In this way is achieved what no other high speed rectifying machine offers, optional determination of two suitable opposite rotor support conditions, for the execution of both the balancing and the rectifying of the rotor. This is achieved by switching between the blocking and no blocking conditions of the elastic joints of the stand. In other words the machine conveniently allows the stand to act as a single rigid part of the rotor support, parts connected to each other by an elastic joint.

Another essential characteristic of the invention is that between sliding table and the machine bed, sliding supports for the table are situated. The supports have associated means for optionally blocking the sliding that are driven in combination with the rotor balance control system, to activate the blocking condition of said table supports which the balancing is done, and to activate the no-blocking state when rectification is performed, since the table must be displaced to find the rotor position relative to the grinding wheel.

Also, none of the known high speed rectifying machines offer this possibility of selecting such conditions, the free sliding or the fixing between the table and the bed of the machine. Here the blocking and no-blocking conditions of the table movement are switched with respect to the standard conditions, since the advantage of the invention is to get the elastic joints of the stand to be rigid when the rectification is performed, blocking its movement.

BEST MODE OF CARRYING OUT THE INVENTION

Figures 1, 2:
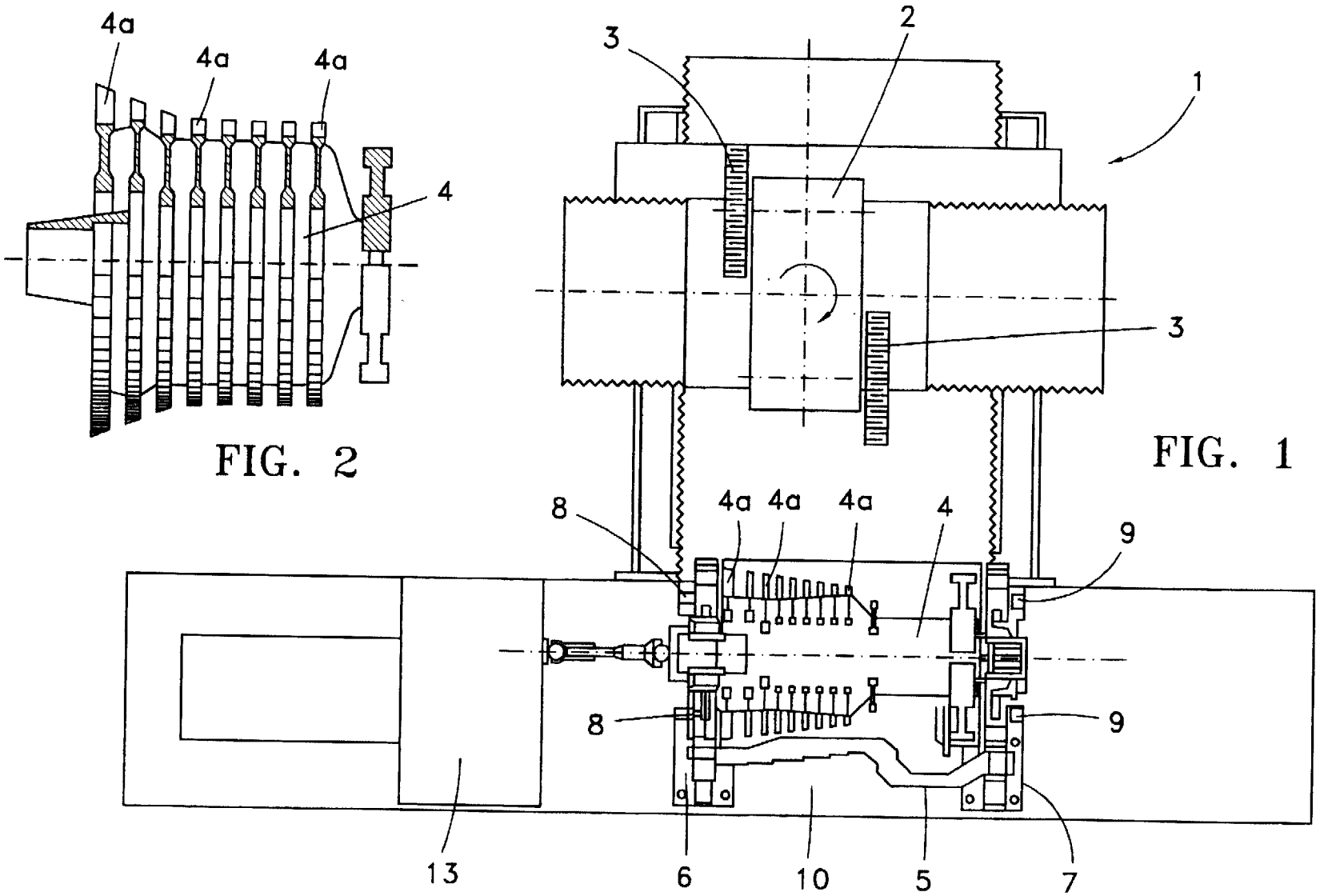
FIG. 1 is a schematic view of the upper level of the high speed rectifying machine built according to the present invention.
FIG. 2 is a perspective view which shows a typical aeronautical rotor, with its blades extended and a section which has eliminated the upper angle closest to the observer.
Figures 3, 3A, 3B, 3C:
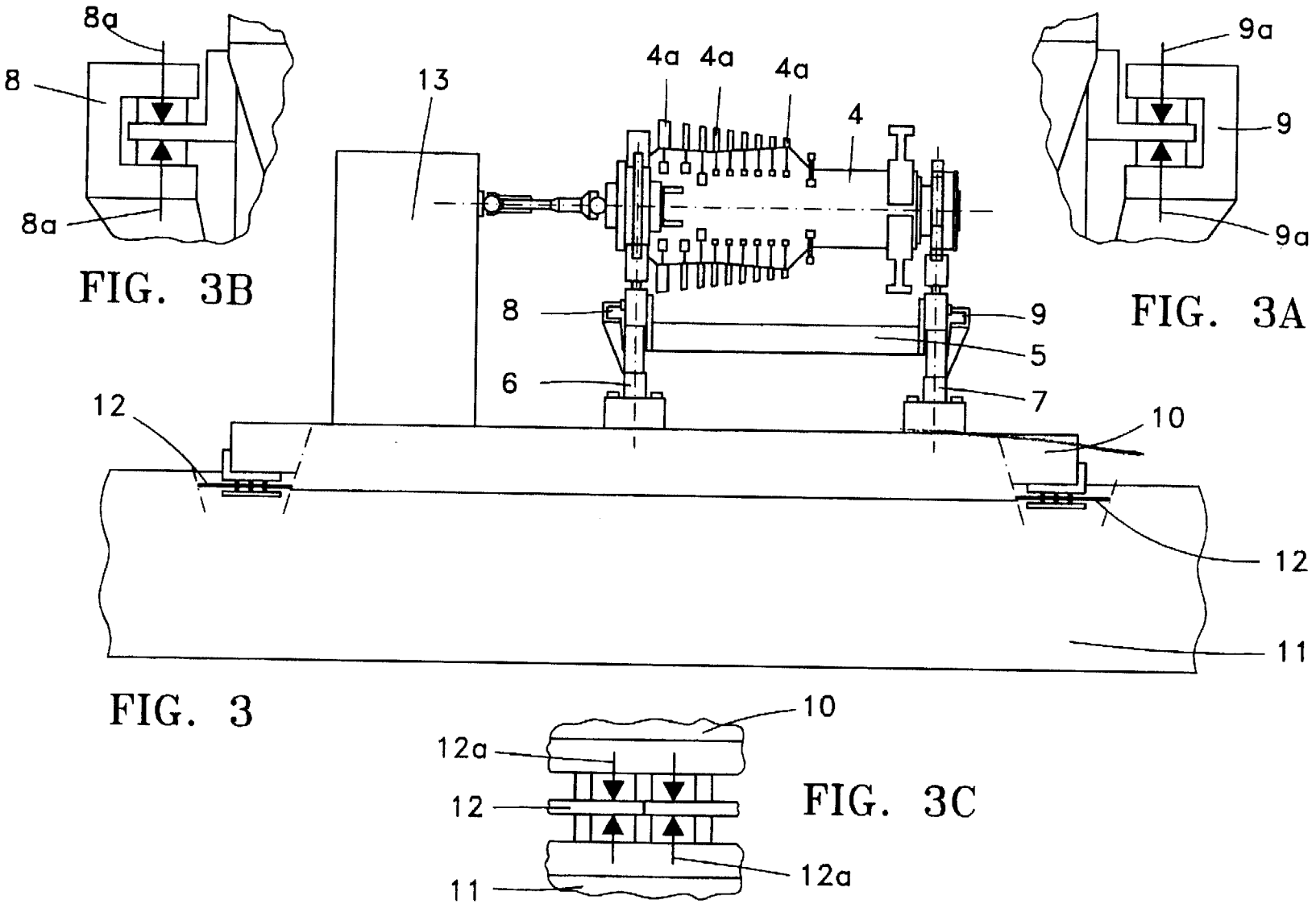
FIG. 3 is a raised frontal view corresponding to partial detail (14) surrounding FIG. 1.
FIG. 3A is the enlarged view corresponding to the detail which appears surrounding FIG. 3.
FIG. 3B is a view which extensively shows the details surrounding FIG. 3.
FIG. 3C is the enlarged view which corresponds to the details that appear surrounding FIG. 3.

In reference to FIGS. 1 thru 3, the high speed rectifying machine of the present invention is intended to perform an accurate rectification of the active profile of the blades 4*a* of a rotor 4 of compressors and aeronautical turbine reaction motors, and similarly high speed rotary devices. In particular, the rectifier 1 is equipped with a header 2 supplied with two shaped grinders 3, each one provided for grinding different blades stages in the rectification operations. The rotor 4 is installed for its mechanizing (FIG. 3) on the joint bridge frame formed by a cradle 5 and two stands 6, 7 over which the rotor 4 is suspended. The stands 6, 7 respectively simulate the point and counterpoint on which the ends of the rotor 4 are rotationally supported. The combination of the rotor 4, its cradle 5 and support stands 6, 7 and its high speed spinning drive unit 13, are installed on the same sliding table 10 supported by the bed 11.

Said stands 6, 7 are not comprised of a single piece, but their legs, between the support areas of the rotor 4 and the sliding table 10 are divided by corresponding elastic joints 8, 9. The joints 8, 9 are with means for blocking their resilient function. The blocking action is shown (FIGS. 3A and 3B) as indicated by arrows (8*a*, 9*a*). The means for blocking the elastic joints (8, 9) act in combination with the machine CNC control to render the stands 6, 7 rigid while the machine is rectifying in order to prevent their flexure under the thrust of the grinding wheel 3 over the rotor 4, and similarly to be elastic when the balancing is performed.

In a similar way, the support of the sliding table 10 relative to the bed 11 is done by the siding supports 12 which are joined by blocking means whose blocking action is symbolized by the arrows in FIG. 3*c*. The blocking means are activated in combination with the CNC control for balancing, so that their un-blocking condition is activated to carry out the rectification, and their blocking condition is activated to produce the blocking of the table from sliding the rotor is being balanced.

I claim:

1. A machine for grinding and balancing rotor blades of an engine comprising:

a machine bed anchored to a working area floor, a sliding table to displace a rotor of the engine on said machine bed, said sliding table has sliding table supports to accomplish movement of said table relative to said bed, a high speed rotary drive system to drive said rotor, a machine CNC to control said rotary drive system and said movement of said sliding table relative to said bed, said machine CNC provides means for a user to select a grinding process or a balancing process, support blocking means associated with said sliding table supports to block movement of said sliding table supports relative to said table, said support blocking means is controlled by said machine CNC, said support blocking means is activated during said balancing process so that said rotor is fixed in place, a rotor support to hold said rotor in position on said sliding table, said rotor support includes a bridge type frame with a stand support at each of two ends of said rotor support, said stand supports each receive an end of said rotor, each said stand support includes electrically operated joints that allow flexure of said stand supports, and each said stand support is provided with joint blocking means to immobilize said joints of said stand support, said joint blocking means is controlled by said machine CNC, said joint blocking means is activated during said grinding process so that said stand supports do not flex during said grinding process; wherein said machine CNC activates said support blocking means to immobilize said sliding table during a balancing process, and said machine CNC activates said joint blocking means to immobilize said joints of said stand supports of said rotor support so that said stand supports do not flex during a grinding process.

* * * * *

UNITED STATES PATENT AND TRADEMARK OFFICE

CERTIFICATE OF CORRECTION

PATENT NO. : 5,685,765

DATED : November 11, 1997

INVENTOR(S) : Azpeitia De Diego

It is certified that error appears in the above-indentified patent and that said Letters Patent is hereby corrected as shown below:

On the title page, item 73, Assignee, please delete "Poligono Industrial Arriaga, Elgoibar. Spain", and insert --DANOBAT, S. COOP. LTDA, Elgoibar, Spain--.

Signed and Sealed this

Fourteenth Day of July, 1998

Bruce Lehman

*Attest:*

BRUCE LEHMAN

*Attesting Officer*

*Commissioner of Patents and Trademarks*